US006948980B2

(12) United States Patent
Xiang et al.

(10) Patent No.: US 6,948,980 B2
(45) Date of Patent: Sep. 27, 2005

(54) SHIELDED ELECTRICAL CONNECTOR

(75) Inventors: XinHai Xiang, Kunsan (CN); Jian Wei Guo, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/979,333

(22) Filed: Nov. 1, 2004

(65) Prior Publication Data

US 2005/0101186 A1 May 12, 2005

(30) Foreign Application Priority Data

Nov. 6, 2003 (CN) ..... 200320120505

(51) Int. Cl.[7] ..... H01R 13/648
(52) U.S. Cl. ..... 439/607
(58) Field of Search ..... 439/606–610, 439/567, 570–573

(56) References Cited

U.S. PATENT DOCUMENTS

D453,500 S * 2/2002 Nakatomi ..... D13/147
6,547,595 B2 4/2003 Tanaka
6,554,642 B1 4/2003 Xiang
6,709,286 B1 * 3/2004 Korsunsky et al. ..... 439/557
6,786,770 B1 * 9/2004 Huang ..... 439/607
2004/0025349 A1 * 2/2004 Tanaka ..... 439/607
2004/0235348 A1 * 11/2004 Murayama ..... 439/607

* cited by examiner

*Primary Examiner*—Renee Luebke
*Assistant Examiner*—James R. Harvey
(74) *Attorney, Agent, or Firm*—Wei Te Chung

(57) ABSTRACT

An electrical connector (100) includes an insulative housing (1), a number of terminals (3) received in the insulative housing, a front shielding member (4) and a rear shielding member (5). The insulative housing defines a pair of bores (16) and a pair of slits (15) extending therethrough at opposite longitudinal ends thereof. The front shielding member defines a pair of engaging holes (430) at opposite ends thereof. The rear shielding member defines a pair of legs (54) extending through the slits. A foot (541) of each leg is sandwiched between the insulative housing and the front shielding member and defines an opening (542) corresponding to the bore of the insulative housing and the engaging hole of the front shielding member.

15 Claims, 5 Drawing Sheets

SHIELDED ELECTRICAL CONNECTOR

BACKGROUND OF THE INVENTION

1. Field of the Invention

The present invention generally relates to an electrical connector, and more particularly to a Digital Visual Interface (DVI) connector shielded from electromagnetic or radio frequency interference.

2. Description of Related Art

The DVI is developed by DDWG which is the abbreviation of "Digital Display Working Group" which was organized by Intel Corporation, Silicon Image, Inc., Compaq Computer Corp., Fujitsu Limited, Hewlette-Packard Company, International Business Machines Corp., and NEC Corporation. The DVI is primarily focused on providing a connection between a computer and a display device through a high-speed DVI connector. The DVI connector ensures all content transferred over this interface remains in the lossless digital domain from creation to consumption. The DVI connector supports not only digital signals but also analog signals.

In high speed applications, EMI (Electro-Magnetic Interference) is one of the major causes for noise. Therefore, suppression of EMI is highly considered in the course of designing DVI connectors. U.S. Pat. No. 6,554,642 discloses a DVI connector. The connector comprises an insulative housing retaining a plurality of conductive contacts therein. The contacts have front and rear sections extends beyond front and rear walls of the insulative housing. A front shielding member is attached to the front side of the insulative housing for surrounding and shielding the front sections of the contacts, and a rear shielding cover is attached to the rear side of the insulative housing for shielding the rear section of the contacts. An electrical connection is established between the front shielding member and the rear shielding cover by spring tabs of the rear shielding cover abutting against a flange of the front shielding member. Thus, the rear shielding cover is suitably grounded.

However, there is enough not reliable retention means to secure the rear shielding cover to the insulative housing, and vibration generated in transport or mating/unmating with a complementary connector may cause the electrical connection between the front shielding member and the rear shielding cover to break, resulting in poor transmission of signals.

Hence, an improved electrical connector is required to overcome the disadvantages of the prior art.

SUMMARY OF THE INVENTION

An object of the present invention is to provide an electrical connector having a rear shielding member securely connected to a insulative housing and reliably contacting with a front shielding member for preventing electromagnetic or radio frequency interference.

In order to achieve the object set forth, an electrical connector in accordance with the present invention comprises an insulative housing, a plurality of terminals, and shielding means. The insulative housing comprises a longitudinal base, a mating portion having a mating face projecting upwardly from the base and a plurality of passages defined therein. The base defines a pair of slits extending therethrough at opposite ends thereof. A pair of bores extend through the base at outer sides of the slits. The terminals are received in corresponding passages and each comprises a contact portion extending into the mating portion of the insulative housing, a connecting portion extending rearwardly from the contact portion out of the base, and a tail portion extending from an end of the connecting portion. The shielding means comprises a front shielding member assembled to the insulative housing and a rear shielding member attached to a rear portion of the insulative housing. The front shielding member comprises a base plate attached to a front face of the base of the insulative housing, a pair of engaging holes located at opposite ends of the base plate in positions corresponding to the bores of the insulative housing. The rear shielding member comprises a top panel, a back panel bent and extending from a rear end of the top panel and a pair of wings extending downwardly from opposite ends of the top panel. Each wing comprises a leg extending forwardly through the slit of the insulative housing and a foot bent perpendicular to the leg and sandwiched by the base and the front shielding member. The foot defines an opening corresponding to the bore of the insulative housing and the engaging hole of the front shielding member.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
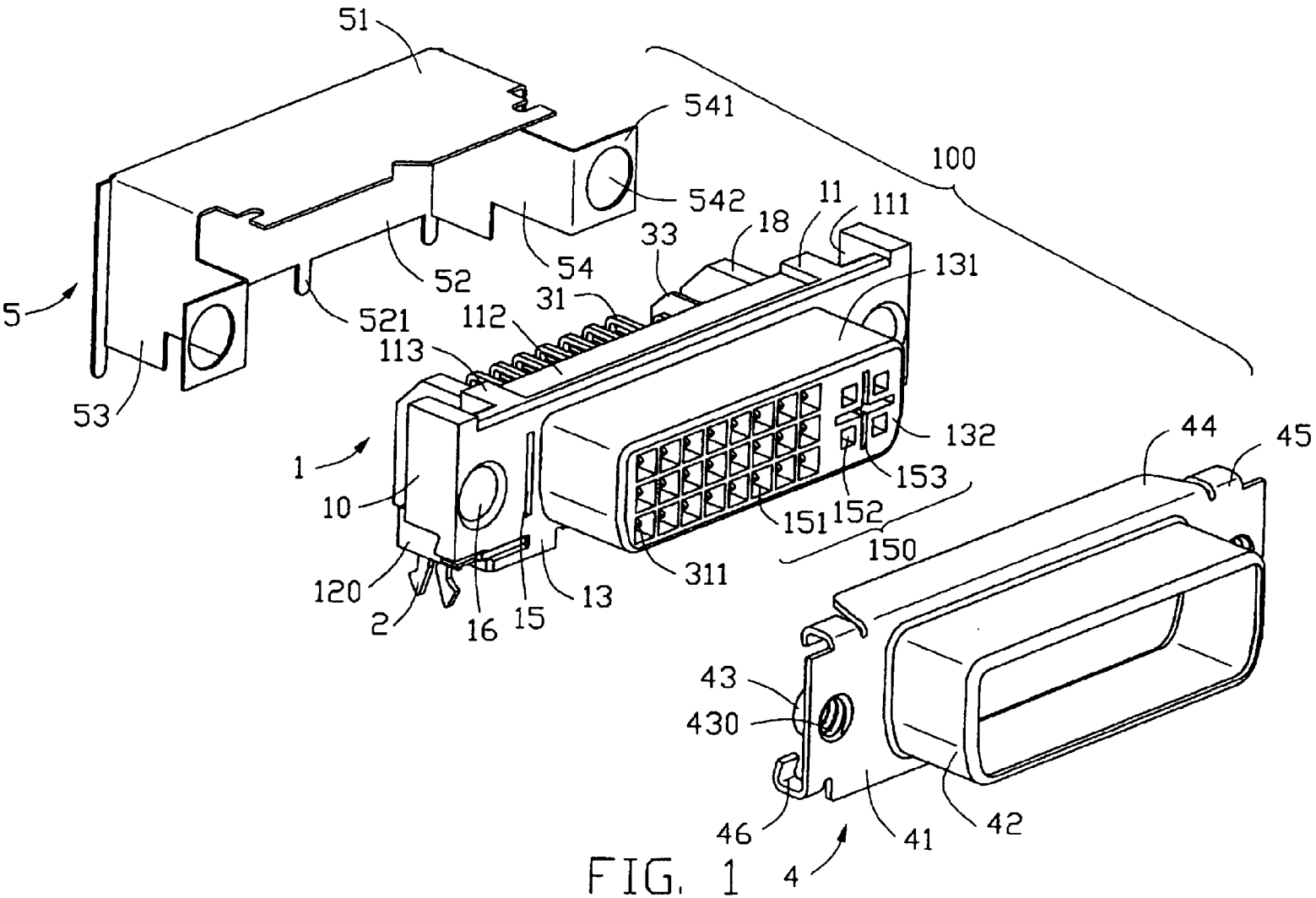
FIG. 1 is an exploded, perspective view of an electrical connector in accordance with the present invention.
Figure 2:
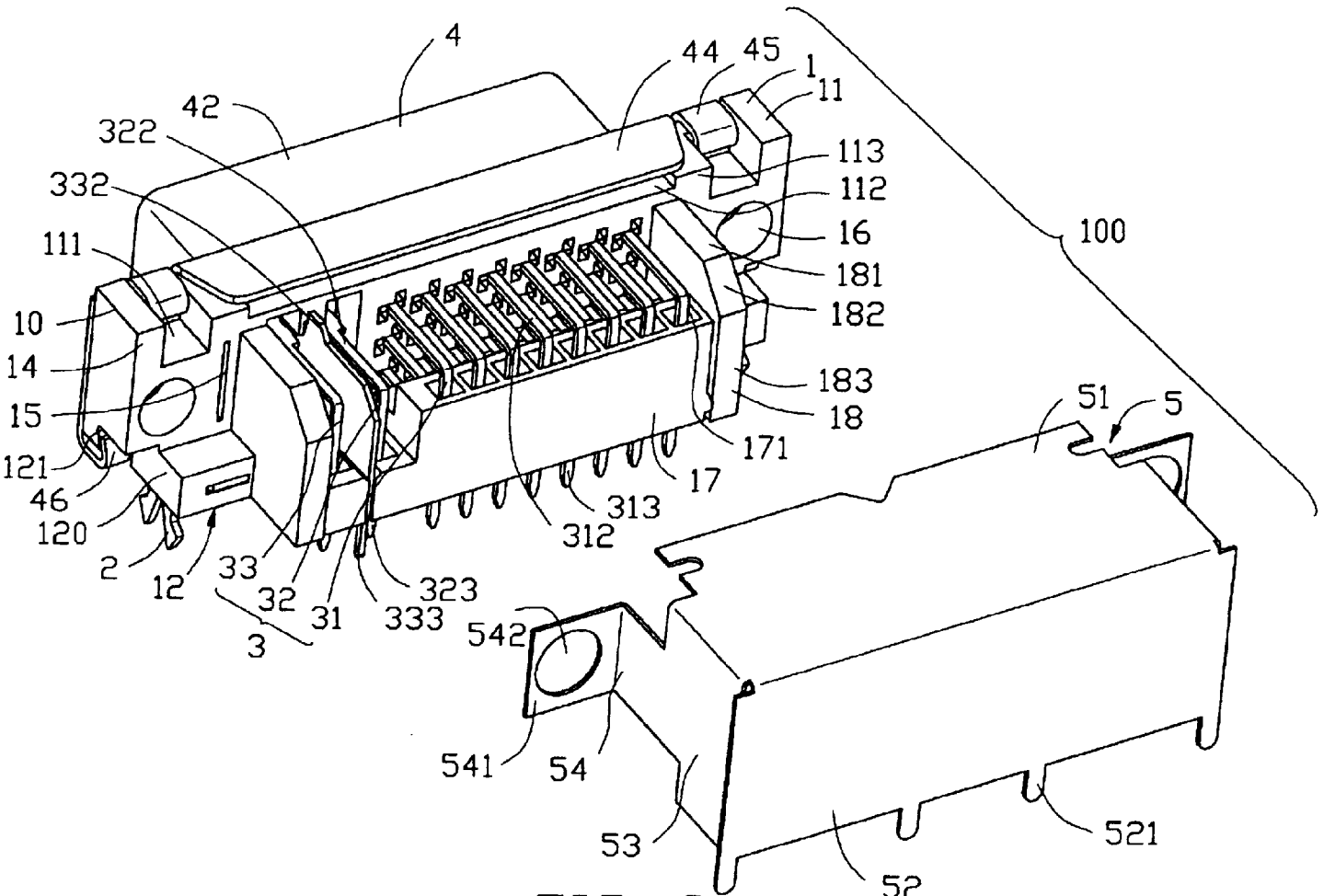
FIG. 2 is a partially assembled, perspective view of the electrical connector of FIG. 1, showing a front shielding member being assembled to an insulative housing.

Referring to FIG. 1 and FIG. 2, an electrical connector 100 in accordance with the present invention comprises an insulative housing 1, a plurality of terminals 3 and a shielding means.

The insulative housing 1 has a longitudinal base 10. The base 10 comprises a top face 11, a mounting face 12 opposite to the top face 11 for contacting with a printed circuit board (PCB, not shown), and a front and rear face 13, 14 connecting the top and mounting face 11, 12. A mating portion 131 extends forwardly from the front face 13 of the base 10 forming a D-shaped mating face 132 at a front end thereof. The base 10 defines a pair of slits 15 and a pair of bores 16 extending therethrough at opposite ends thereof, along a direction parallel to the mounting face 12 of the insulative housing 1. The slit 131 is closer to the mating portion 131 than the bore 16. The insulative housing 1 comprises two notches 111 defined in the top face 11 of the base 10, a pair of protrusions 113 adjacent to the notches 111, a recess 112 formed between the protrusions 113, a pair of parallel partition walls 18 extending rearwardly from the rear face 14 of the base 10 and a spacer 17 fixed between the partition walls 18. The partition wall 18 comprises a horizontal upper face 181 on a top thereof, an inclined face 182 extending downwardly from the upper face 181 and a vertical lower face 183 dependent on the inclined face 182. The spacer 17 defines a plurality of passageways 171 extending therethrough.

The mating portion 131 of the insulative housing 1 defines a plurality of passages 150 extending through the base 10. In the embodiment illustrated, the passages 150 comprises a plurality of first passageways 151 arranged in three parallel rows, second passageways 152, and third passageways 153 crossed each other and positioned between the second passageways 152. A pair of flanges 120 extend rearwardly from opposite ends of the base 10 and connect to the partition walls 18. A pair of board locks 2 are assembled in the flanges 120 with legs (not labeled) thereof extending through the mounting face 12 of the insulative housing 1, so as to secure the electrical connector 100 on the PCB. When the legs are connected with a grounding trace on the PCB, the board locks 2 also function as a grounding device of the electrical connector 100. A pair of cutouts 121 are formed in a bottom portion of the base 10 and locate at outer sides of the flanges 120.

Terminals 3 comprise a plurality of first terminals 31 for transmitting digital signals, a plurality of second terminals 32 for transmitting analog signals, and third terminals 33 for grounding. Each first terminal 31 has a mating portion 311 received and retained in corresponding first passageways 150, a tail portion 313 extending through corresponding passageways 171 of the spacer 17, and an arc connecting portion 312 connecting between the mating portion 311 and the tail portion 312 whereby the tail portion 313 is substantially perpendicular to or inclined at a predetermined angle with respect to the mating portion 311. Similarly, each second or third terminal 32, 33 has a mating portion (not shown) received in corresponding second or third passageways 152, 153, a tail portion (not shown) extending through corresponding passageways 171, and a connecting portion (not labeled) connecting between the mating portion and the tail portion.

The metallic shielding means is formed by a front shielding member 4 and a rear shielding member 5. The front shielding member 4 comprises a base plate 41 attached to the front face 13 of the insulative housing 1 and a shroud wall 42 formed on the base plate 41. The shroud wall 42 surrounds the mating portion 131 of the insulative housing 1 with the mating face 132 exposed out. The base plate 41 comprises a pair of posts 43 defining a pair of through engaging holes 430 therein corresponding to the bores 16 of the insulative housing 1, a top flange 44 extending rearwardly from a top end thereof to partially overlap and cover the top face 11 of the insulative housing 1, a pair of upper tabs 45 extending from the top end thereof and a pair of lower tabs 46 extending from bottom end thereof. The upper tabs 45 and the lower tabs 46 locate on opposite sides of the base plate 41 for being bent into and thus engaging with corresponding notches 111 and cutout 121, to attach the front shielding member 4 to the insulative housing 1.

The rear shielding member 5 is attached to a rear end of the insulative housing 1 for covering and shielding a rear section of the terminals 3 which exposed outside of the rear face 14 of the insulative housing 1. The rear shielding member 5 comprises a top panel 51, a back panel 52 bent and extending from a rear end of the top panel 51 and a pair of wings 53 extending downwardly from opposite ends of the top panel 51 for abutting against the partition walls 18 of the insulative housing 1. Each wing 53 comprises a leg 54 extending forwardly and a foot 541 bent perpendicular to the leg 54. The foot 541 defines an opening 542 corresponding to the bore 16 of the insulative housing 1 and the engaging hole 430 of the front shielding member 4. The back panel 52 forms a plurality of grounding tabs 521 extending downwardly from a bottom edge thereof for connecting with a grounding trace on the PCB, to build a grounding path between the electrical connector 100 and the PCB.

Figure 3:
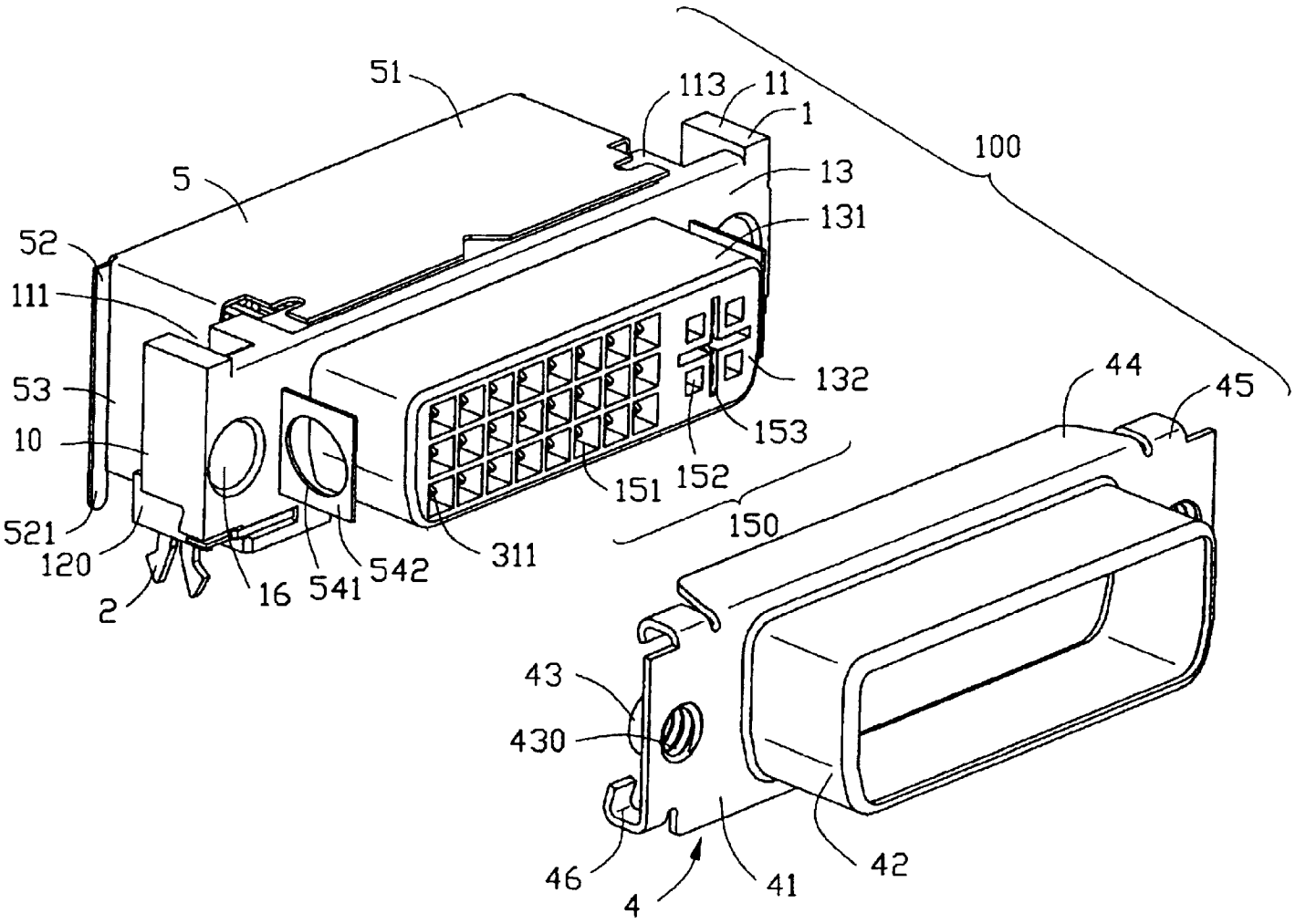
FIG. 3 is a partially assembled, perspective view of the electrical connector of FIG. 1, showing a rear shielding member being assembled to the insulative housing.
Figure 4:
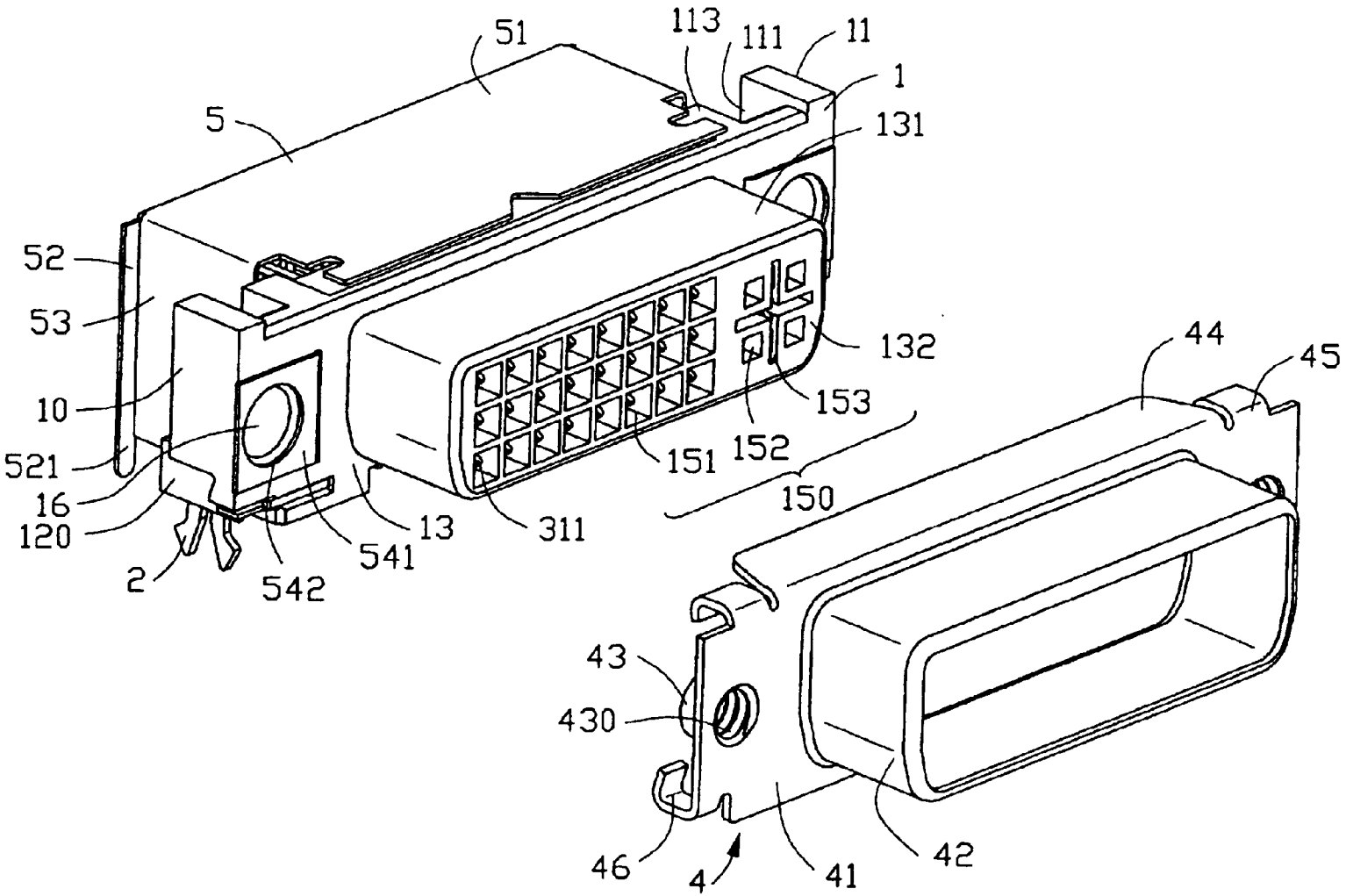
FIG. 4 is a view similar to FIG. 3, showing legs of the rear shielding member being bent to be securely assembled to the insulative housing.
Figure 5:
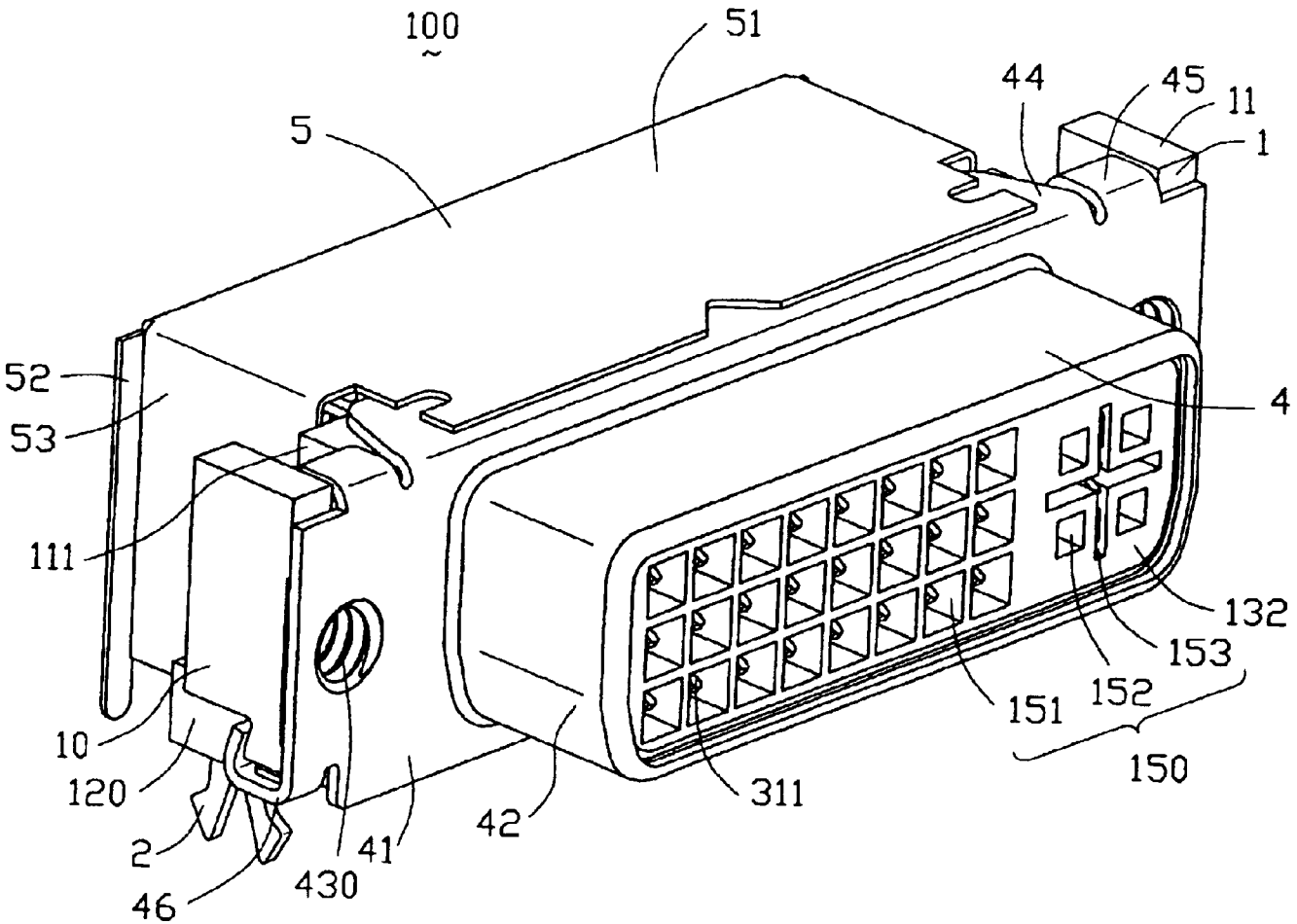
FIG. 5 is an assembled view of the electrical connector of FIG. 1.

Referring to FIGS. 1–2 in conjunction with FIGS. 3–5, in assembly, the rear shielding member 5 is assembled to the rear end of the insulative housing 1 by inserting the legs 54 thereof through the slits 15 of the insulative housing 1. Then, the foot 541 is bent to be perpendicular to the leg 54 to abut against the rear face 14 of the insulative housing 1. The top flange 44 of the front shielding member 4 abuts against the top face 11 of the insulative housing 1, covers the recess 112 and contacts with a bottom face of the top panel 51 of the rear shielding member 5. The posts 43 go through the openings 542 of the rear shielding member 5 and the bores 16 of the insulative housing 1, respectively. At the same time, the base plate 41 of the front shielding member 4 substantially contacts the foot 541 of the rear shielding member 5. Finally, the front shielding member 4, the insulative housing 1 and the rear shielding member 5 are tightly attached to each other via a fastener (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing comprising a longitudinal base, a mating portion projecting forwardly from the base, a mating face in a front thereof and an opposite rear face, the base defining a pair of slits and a pair of bores extending therethrough at opposite ends thereof;

a plurality of terminals received in the housing;

a front shielding member being assembled to the insulative housing and comprising a base plate attached to the base of the insulative housing, and a pair of engaging holes located at opposite ends of the base plate in positions corresponding to the bores of the insulative housing;

a rear shielding member being attached to the rear face of the insulative housing and comprising a top panel, a back panel bent and extending from a rear end of the top panel and a pair of wings extending downwardly from opposite ends of the top panel, each wing comprising a leg extending forwardly through one of the slits of the insulative housing and a foot bent perpendicular to the leg and sandwiched by the base and the front shielding member, the foot defining an opening corresponding to one of the bores of the insulative housing and one of the engaging holes of the front shielding member.

2. The electrical connector as claimed in claim 1, wherein said front shielding member comprises a top flange electrically connecting with the top panel of the rear shielding member.

3. The electrical connector as claimed in claim 2, wherein the back panel of the rear shielding member has at least one grounding tab extending downwardly from a bottom edge thereof.

4. The electrical connector as claimed in claim 2, wherein the front shielding member comprises a shroud wall formed on the base plate and substantially enclosing the mating portion of the insulative housing.

5. The electrical connector as claimed in claim 4, wherein the base of the insulative housing has a pair of notches defined thereon, and wherein the top flange of the front shielding member comprises a pair of upper tabs at opposite sides thereof engaging with said notches.

6. The electrical connector as claimed in claim 5, wherein the bores of the base are located at outer sides of the slits.

7. The electrical connector as claimed in claim 6, wherein the base comprises a pair of opposite cutouts in a bottom portion thereof, and wherein the base plate of the front shielding member has a pair of lower tabs extending rearwardly from a bottom edge thereof engaging with said cutouts.

8. The electrical connector as claimed in claim 7, wherein the base comprises a pair of protrusions adjacent to the notches and a recess formed between the protrusions, and wherein the top flange of the front shielding member abuts against the protrusions and covers the recess.

9. The electrical connector as claimed in claim 8, wherein a pair of parallel partition walls extends rearwardly from the base, and the wings of the rear shielding member abut against corresponding partition walls.

10. The electrical connector as claimed in claim 9, wherein the insulative housing comprises a spacer disposed between the two partition walls, the spacer defining a plurality of passageways for insertion of the terminals therethrough.

11. The electrical connector as claimed in claim 10, wherein the insulative housing comprises a plurality of passages therein, the passages comprise first passageways arranged in three parallel rows, second passageways, and third passageways crossed each other and positioned between the second passageways.

12. The electrical connector as claimed in claim 11, wherein the terminals are received in corresponding passages, each terminal comprises a contact portion extending into the mating portion of the insulative housing, a connecting portion extending rearwardly from the contact portion and out of the base, and a tail portion extending from an end of the connecting portion.

13. The electrical connector as claimed in claim 1, further comprising a board lock assembled to the insulative housing.

14. An electrical connector comprising:

an insulative housing defining a longitudinal direction with two opposite end sections thereof;

a mating port extending forward from a front face of the housing in a front-to-back direction perpendicular to said longitudinal direction;

a plurality of contacts disposed in the housing and extending into the mating port;

a pair of bores and a pair of slits extending through the opposite end sections in said front-to-back direction, respectively; and a rear metallic shell enclosing a rear portion of the housing and including a pair of legs located respectively around the corresponding end sections and extending forwardly, a foot located at a front end of each of said legs and defining an opening therein; wherein said foot is originally coplanar with said leg and associatively extends forwardly through the corresponding slit from the rear portion of the housing and is successively bent at a right angle to cover the front face with the opening in alignment with the corresponding bore.

15. A method of making an electrical connector comprising steps of:

providing an insulative housing with two opposite end sections in a longitudinal direction and with a mating port extending forwardly from a front face thereof;

forming a pair of bores and a pair of slits extending through the corresponding end sections in a front-to-back direction perpendicular to said longitudinal directional, respectively, disposing a plurality of contacts in the housing and in communication with the mating port;

providing a rear metallic shell with a pair of legs at two ends in said longitudinal direction, respectively;

providing a foot at a front end of each of said legs with an opening therein; and attaching said shell to the housing by initially inserting the foot through the corresponding slit and successively angularly bending the foot to cover the front face with the opening in alignment with the corresponding bore.

* * * * *